US007014029B2

(12) United States Patent
Winters

(10) Patent No.: US 7,014,029 B2
(45) Date of Patent: Mar. 21, 2006

(54) METHODS AND SYSTEMS FOR DETECTING COIN FRAUD IN COIN-COUNTING MACHINES AND OTHER DEVICES

(75) Inventor: Gregory Winters, Snohomish, WA (US)

(73) Assignee: Coinstar, Inc., Bellevue, WA (US)

( * ) Notice: Subject to any disclaimer, the term of this patent is extended or adjusted under 35 U.S.C. 154(b) by 110 days.

(21) Appl. No.: 10/313,944

(22) Filed: Dec. 5, 2002

(65) Prior Publication Data

US 2003/0111316 A1 Jun. 19, 2003

Related U.S. Application Data

(60) Provisional application No. 60/337,409, filed on Dec. 5, 2001.

(51) Int. Cl.
*G07D 5/00* (2006.01)

(52) U.S. Cl. ..... 194/302; 73/163

(58) Field of Classification Search ..... 73/163; 194/303, 217, 216, 215, 302, 317
See application file for complete search history.

(56) References Cited

U.S. PATENT DOCUMENTS 4,538,719 A * 9/1985 Gray et al. ..... 194/317
5,330,041 A * 7/1994 Dobbins et al. ..... 194/206
5,351,798 A * 10/1994 Hayes ..... 194/318
5,379,876 A 1/1995 Hutton
6,293,385 B1 * 9/2001 Hayashi et al. ..... 194/317
2001/0013456 A1 * 8/2001 Ishida et al. ..... 194/217

FOREIGN PATENT DOCUMENTS

EP 0 685 826 A2 12/1995
WO WO 99/49423 A1 9/1999
WO WO 00/48138 A1 * 8/2000

OTHER PUBLICATIONS

International Search Report, International Application No. PCT/US02/39212, Jun. 2, 2003, 3 pages.

* cited by examiner

*Primary Examiner*—Donald P. Walsh
*Assistant Examiner*—Mark J. Beauchaine
(74) *Attorney, Agent, or Firm*—Perkins Coie LLP

(57) ABSTRACT

Methods and systems for detecting coin fraud in coin-counting machines and other devices that count and/or sort coins and other objects. In one embodiment, the method includes discriminating multiple coins to determine a number of real coins and a number of faux coins. In one aspect of this embodiment, the faux coins can have one or more coin characteristics falling generally close to corresponding characteristics of the real coins. The method can further include determining a quotient based on the number of real coins and faux coins. If the determined quotient is greater than or equal to a selected threshold value, then the transaction can be identified as being possibly fraudulent. In the event of a possibly fraudulent transaction, the method can include controlling the transaction, for example, by returning any uncounted coins to a user, or by halting the transaction.

35 Claims, 5 Drawing Sheets

METHODS AND SYSTEMS FOR DETECTING COIN FRAUD IN COIN-COUNTING MACHINES AND OTHER DEVICES

CROSS-REFERENCE TO RELATED APPLICATION(S)

The present application claims priority to U.S. patent application Ser. No. 60/337,409, titled "METHODS AND SYSTEMS FOR DETECTING COIN FRAUD, SUCH AS COIN FRAUD IN COIN-COUNTING MACHINES," filed Dec. 5, 2001, and incorporated herein in its entirety by reference.

The following patents and patent applications, having common ownership with the present application, are hereby incorporated by reference: U.S. Pat. No. 5,564,546; U.S. Pat. No. 5,620,079; U.S. Pat. No. 5,909,794; U.S. patent application Ser. No. 09/450,824; U.S. Pat. No. 5,746,299; U.S. Pat. No. 5,957,262; U.S. Pat. No. 6,047,808; U.S. Pat. No. 5,988,348; U.S. Pat. No. 6,196,371; U.S. Pat. No. 5,842,916; U.S. Pat. No. 6,082,519; U.S. Pat. No. 6,168,001; U.S. Pat. No. 6,116,402; U.S. Pat. No. 6,349,972; U.S. patent application Ser. No. 09/662,414; U.S. patent application Ser. No. 10/020,587; U.S. patent application Ser. No. 09/849,941; and U.S. patent application Ser. No. 09/972,050.

TECHNICAL FIELD

The following disclosure relates generally to methods and systems for detecting coin fraud and, more particularly, to methods and systems for detecting coin fraud in coin-counting machines.

BACKGROUND

Typical coin-counting machines discriminate coins by passing them by one or more sensors that read properties or characteristics of the coins, such as material or size characteristics. Generally, when a coin of a particular denomination is examined, the sensors return a reading for each coin characteristic of interest. A range of acceptable reading values (e.g., a "window") can be defined for each coin characteristic of interest. For a particular coin to be accepted, each of the characteristic readings for that coin must fall within the defined window for that characteristic.

Determining the sizes of the windows often involves trade-offs between rejecting desirable coins that are on the margin and accepting undesirable (e.g., foreign or counterfeit) coins. As a result, the window sizes are often selected such that a portion of undesirable coins having characteristics close to the desirable coins will be accepted by the coin-counting machine. This raises the possibility of coin fraud by persons placing undesirable coins into the machine that have characteristics close to the characteristics of the desirable coins.

One method for preventing this type of coin fraud in coin-counting machines is to obtain a representative sample of the undesirable coin type that is being erroneously accepted, and adjusting the characteristics windows to exclude such coins. While this approach may be satisfactory for some coin types, it is often unsatisfactory for others because it can lead to an unacceptable rate of rejection of desirable coins. In addition, in some cases undesirable coins have characteristics that are so close to the desirable coins that it is difficult to exclude the undesirable coins by narrowing the windows of acceptability. As a result, a coin-counting machine may be able to reject a substantial portion of the undesirable coins, but enough of the undesirable coins are still accepted to encourage the defrauder to continue placing them in the coin-counting machine for credit. One method of addressing this problem has been to simply discontinue accepting the particular type of coin being defrauded. While this approach may be effective, it greatly reduces the benefits offered by coin-counting machines.

DETAILED DESCRIPTION

Figure 1:
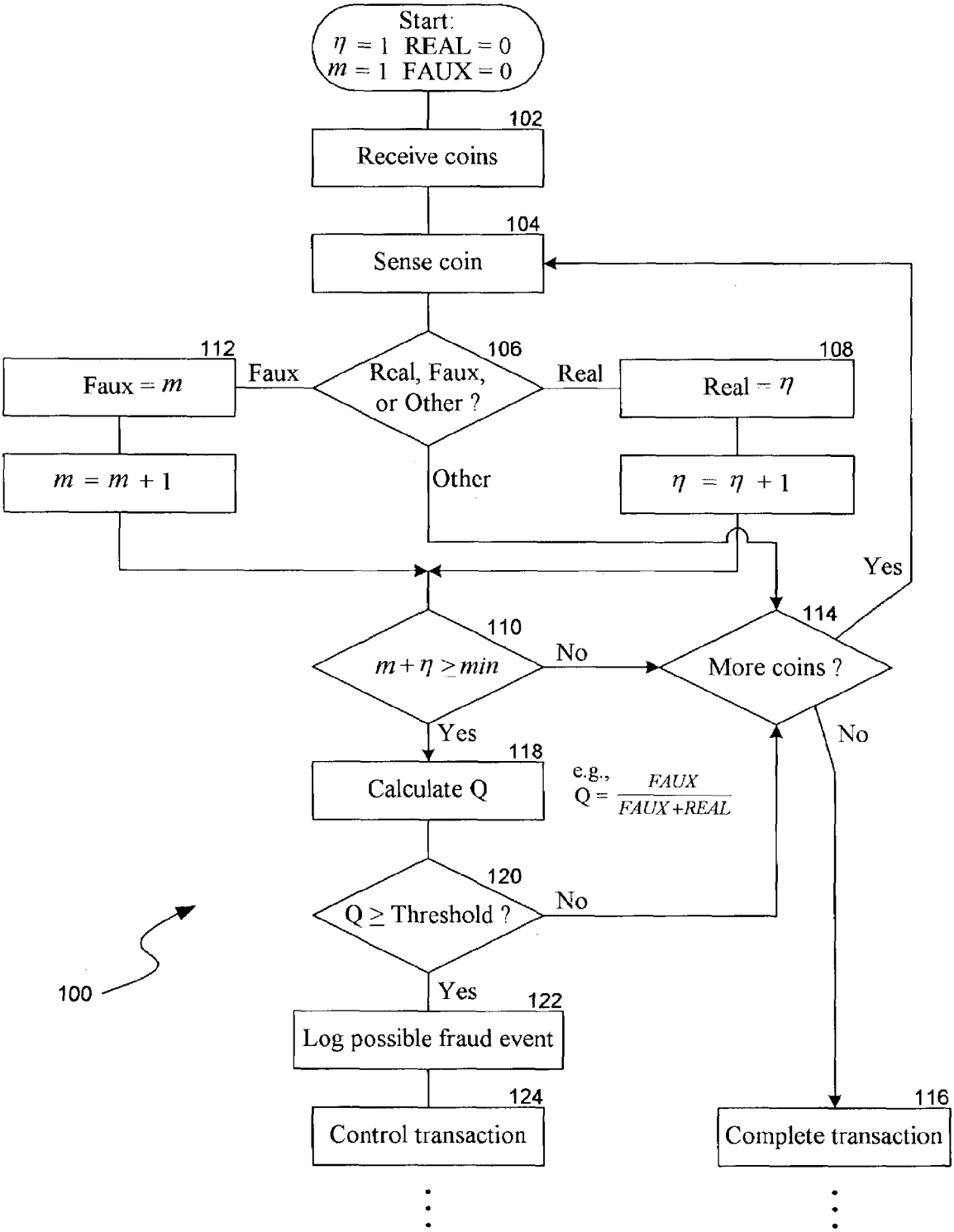
FIG. 1 is a routine for detecting coin fraud in a coin-counting machine in accordance with an embodiment.

The following disclosure describes methods and systems for detecting fraud in coin-counting machines and other devices that count or sort coins and/or other objects. In one embodiment, the methods and systems disclosed operate on the principle that detecting coin fraud in a given transaction can be based on prior coin rejections in the transaction, and not just on the results of individual coin examinations. For example, some foreign/counterfeit coins have sensor characteristics that as a group partially overlap the sensor characteristics of desirable coins. As a result, coin-counting machines often accept some foreign/counterfeit coins as genuine, but many will be different enough to be rejected in significant numbers. During a fraudulent transaction where foreign/counterfeit coins are being fed into a coin-counting machine with desirable coins, a higher than normal reject rate may occur because the sensor rejects some of the foreign/counterfeit coins that fall outside of the acceptance criteria of the desirable coins.

One aspect of the invention is to use this higher-than-normal reject rate to detect coin fraud. Rather than accepting a coin based solely on its own sensor characteristics, this method takes into account how many prior coins were "close" to being accepted but were rejected. If the coin-counting machine is detecting a significant proportion of faux coins in a given transaction, then there is a high probability that the transaction is fraudulent.

In one method under the invention, a coin-counting machine discriminates multiple coins and records how many of the coins meet all of the criteria for being accepted (defined herein as "real" coins) and records how many of the coins are "close" to being accepted but are rejected (defined herein as "faux" coins). (Faux coins are distinct from "rejectable" coins and other objects that are not close to being accepted and are clearly unacceptable.) A value or quotient based on the number of real coins and the number of faux coins can then be calculated that indicates the probability of the coin transaction being fraudulent. For example, in one embodiment, this quotient is equal to the ratio of faux coins to real coins. If this ratio exceeds a predetermined threshold (for example, 30%), then the transaction can be identified as having a high probability of being fraudulent. In another embodiment, if the ratio of faux coins to the total of faux coins plus real coins exceeds a predetermined threshold, then the transaction can be identified as having a high probability of being fraudulent.

Once a transaction is flagged as being fraudulent, several actions can be taken, including one or more of the following:

- A notation can be made in an electronic log indicating the time of the possible fraud event. This notation can be used in conjunction with a video camera monitoring use of the coin-counting machine.
- The coin-counting machine can notify authorized personnel of possible fraud via a phone line connected to the machine or by other means, such as wireless means.
- The coin-counting machine can reject all coins of the denomination or type that are being defrauded during the remainder of the transaction.
- The coin-counting machine can halt the transaction requiring authorized personnel to intervene at the coin-counting machine before the person providing the coins can receive value for his or her coins. In addition, the authorized personnel can be notified that there appears to be a high proportion of rejected coins in the transaction and, as such, he or she can be instructed to examine the coins in the machine not yet counted to determine if they are fraudulent.
- The coin-counting machine can automatically implement a secondary coin check to determine if the uncounted coins are fraudulent. For example, in one embodiment the coin-counting machine can take digital images of one or more of the uncounted coins and compare the digital images to a database of real coin images to determine if the uncounted coins are fraudulent.

Another aspect of the invention involves defining the faux range of coin characteristics to be close to, but not overlapping, the real range of coin characteristics. As a coin passes through a coin-discriminator, the coin passes one or more coin sensors that produce readings describing the characteristics of the coin. When the coin falls within the real range of all characteristics applicable to that specific coin type, it is considered to be acceptable and the coin-counting machine increments the counts for that coin type. Further, if the coin is identified as real, it can be retained by the coin-counting machine. Conversely, if the coin is identified as faux, it can be returned to the user.

In practice, the faux coin characteristics may overlap a portion of the real coin characteristics. To address this situation, the order of coin recognition by the coin-counting machine (coin sensor/discriminator) may be arranged so that as a coin is being evaluated, the coin-counting machine checks the real ranges first and the faux ranges second. This approach can ensure that the customer receives credit for all real coins. Any coins whose readings fall within the parameters for real coins will be counted as real, and only those coins that fall outside real ranges will be counted as faux. Because it is reasonable to expect that there will be some real coins rejected from time to time, the coin-counting machine cannot declare a fraudulent transaction every time a faux coin is detected. To avoid this, in one embodiment, the coin-counting machine only checks for a fraudulent transaction periodically after a minimum number of coins has been sensed in a given transaction. Once the minimum number of coins has been sensed, the coin-counting machine can check to see if the ratio of faux coins to the sum of faux coins plus real coins exceeds a selected threshold. If that threshold is exceeded, the transaction can be flagged as possibly fraudulent.

Although the following disclosure provides specific details for a thorough understanding of several embodiments of the methods and systems described, one of ordinary skill will understand that these embodiments can be practiced without some of these details. In other instances, it will be understood that the methods and systems disclosed can include details without departing from the spirit or scope of the described embodiments. Although some embodiments are described in the context of coin-counting machines configured to count multiple coins received somewhat simultaneously in random orientation, it will be understood that the methods and systems disclosed are equally suitable for much broader applications.

Certain embodiments of the methods and systems disclosed are described in the context of computer-executable instructions executed by a general-purpose computer, such as a general-purpose computer controlling the operation of a coin-counting machine. In one embodiment, such computer-executable instructions for detecting coin fraud in a coin-counting machine can be stored on a computer-readable medium, such as a floppy disk or CD-ROM. In other embodiments, these instructions can be stored on a server computer system and accessed via an intranet, the internet or other computer network. Because of the structures and functions often associated with such computer-executable routines and corresponding computer implementation systems are well known, they have not been shown or been described in detail here to avoid unnecessarily obscuring the described embodiments.

FIG. 1 is a flow diagram of a routine 100 for detecting coin fraud in accordance with one embodiment. In one aspect of this embodiment, the routine 100 can be performed in a coin-counting machine according to computer-readable instructions stored on a computer-readable medium. In other embodiments, the routine 100 can be performed in other devices that count or sort coins and/or other objects. After initializing certain values (discussed below), in block 102, the routine 100 receives multiple coins and/or other objects. In block 104, the routine 100 senses a first coin of the multiple coins. In one embodiment, the term "senses" as used herein means that one or more of the coin's characteristics have been measured. Such characteristics can include composition characteristics or various dimensional characteristics of the coin. In decision block 106, the routine 100 determines if the coin is a real coin, a faux coin, or "other" based on the sensed characteristics of the coin. Specifically, the routine 100 first determines if the coin is a real coin by determining if the characteristics of the coin fall within the range of coin characteristics associated with real coins. If the coin does not fall within the real range, then the routine 100 determines if the coin falls within the faux range of coin characteristics. If the coin falls within the faux range, then it is determined to be a faux coin. If the coin falls outside of the faux and real ranges, then the coin is an "other" and is an obvious reject that is not counted. If the coin is an "other," then the routine 100 proceeds to decision block 114 to determine if there are more coins to be counted.

Returning to decision block 106, if the coin is determined to be a real coin, then in block 108 the routine 100 increments the number of real coins by one and proceeds to decision block 110. If, however, the coin is determined to be a faux coin, then in block 112 the routine 100 increments the number of faux coins by one and proceeds to decision block 110.

In decision block 110, the routine 100 determines if the total number of coins counted up to that point in the transaction is greater than or equal to a predetermined minimum number. In one aspect of this embodiment, this step is added to prevent the coin-counting transaction from being halted after only a relatively insignificant number of coins have been counted. For example, in one embodiment, the minimum number of coins can be less than 20 coins. In another embodiment, the minimum number of coins can be less than 10 coins, such as about 6 coins. If the minimum number of coins has not been counted yet, then the routine 100 proceeds to decision block 114 to determine if there are more coins to be counted. If there are more coins to be counted, then the routine 100 returns to block 104 to sense the next coin. Conversely, if there are no more coins to be counted, then the routine 100 completes the coin counting transaction in block 116. Completing the transaction in block 116 can include issuing the user of the coin-counting machine a redeemable voucher in return for a value related to the value of the real coins counted in the transaction.

Returning to decision block 110, if the number of coins counted is greater than or equal to the minimum required to check for fraud, then the routine 100 calculates or determines a value, such as a ratio or quotient Q, based on the number of faux coins and real coins counted in block 118. In one embodiment, the quotient Q can be equal to the number of faux coins divided by the number of faux coins plus the number of real coins, namely:

$$Q=[\#\text{faux coins}]/[[\#\text{faux coins}]+[\#\text{real coins}]]$$

In other embodiments, other quotients can be used. For example, in one other embodiment, the quotient Q can be equal to the number of faux coins divided by the number of real coins. In further embodiments, other non-quotient values can be used. For example, in another embodiment, the total number of faux coins counted can be used. In a further embodiment, a linear or non-linear function using the total number of faux coins counted can be calculated in block 118. As will be appreciated by those of ordinary skill in the art, the number of faux coins counted can be used in a number of different ways and forms to provide information about the veracity of a given coin-counting transaction consistent with this disclosure.

In decision block 120, the routine 100 determines if the quotient Q is greater than or equal to a preselected threshold value. In one embodiment, the threshold value can be a percentage less than 50%, such as 40%. In other embodiments, other threshold values can be used. For example, in another embodiment, the threshold value can be equal to about 30%. If the quotient Q is not equal to or greater than the threshold value, then the routine 100 returns to decision block 114 to determine if there are more coins to be counted. Conversely, if the quotient Q is equal to or greater than the threshold value, then the routine 100 logs a possible fraud event in block 122.

As discussed above, logging a possible fraud event can include recording, locally or remotely, an electronic notation indicating the time of the event and/or other information, such as total coin amounts, signal output from coin sensors indicating the degree a coin characteristic deviated from an ideal coin characteristic, etc. In addition, logging the possible fraud event can include starting a video recording of the coin-counting machine user, or making a suitable notation on a continuous video recording of coin-counting machine users. In one embodiment, the video of the transaction may be subsequently used for prosecuting a suspected defrauder. In other embodiments, other actions can be taken if a possible coin fraud is detected. For example, in one embodiment, the coin-counting machine can notify authorized personnel of the possible fraud via a phone line connected to the coin-counting machine or via a wireless connection. Further, such authorized personnel may be sent an email page, or a prerecorded telephonic message. Such personnel may be located proximate to the coin-counting machine, for example, in the retail outlet where the coin-counting machine is located, or such personnel may be located remotely from the coin-counting machine at a central facility.

In block 124, the routine 100 can take other steps to control the transaction once a possible coin fraud event has been detected. For example, in one embodiment where the routine 100 determines that a coin fraud has been perpetrated with regard to a particular coin denomination, the coin-counting machine can reject all coins of that denomination for the remainder of the transaction. In another embodiment, the coin-counting machine can halt the transaction after a possible fraud event has been detected, requiring intervention of authorized personnel at the coin-counting machine in order for the user who deposited the coins to receive value for his or her coins. In addition, the authorized personnel can be notified that there appears to be a disproportionate number of faux coins in the coin-counting machine, and the authorized personnel can accordingly be instructed to examine the remainder of the coins not yet counted to determine if they are in fact genuine. As will be appreciated by those with a skill in the relevant art, various modifications can be made to the foregoing routine without departing from the spirit or scope of the present disclosure.

Figure 2:
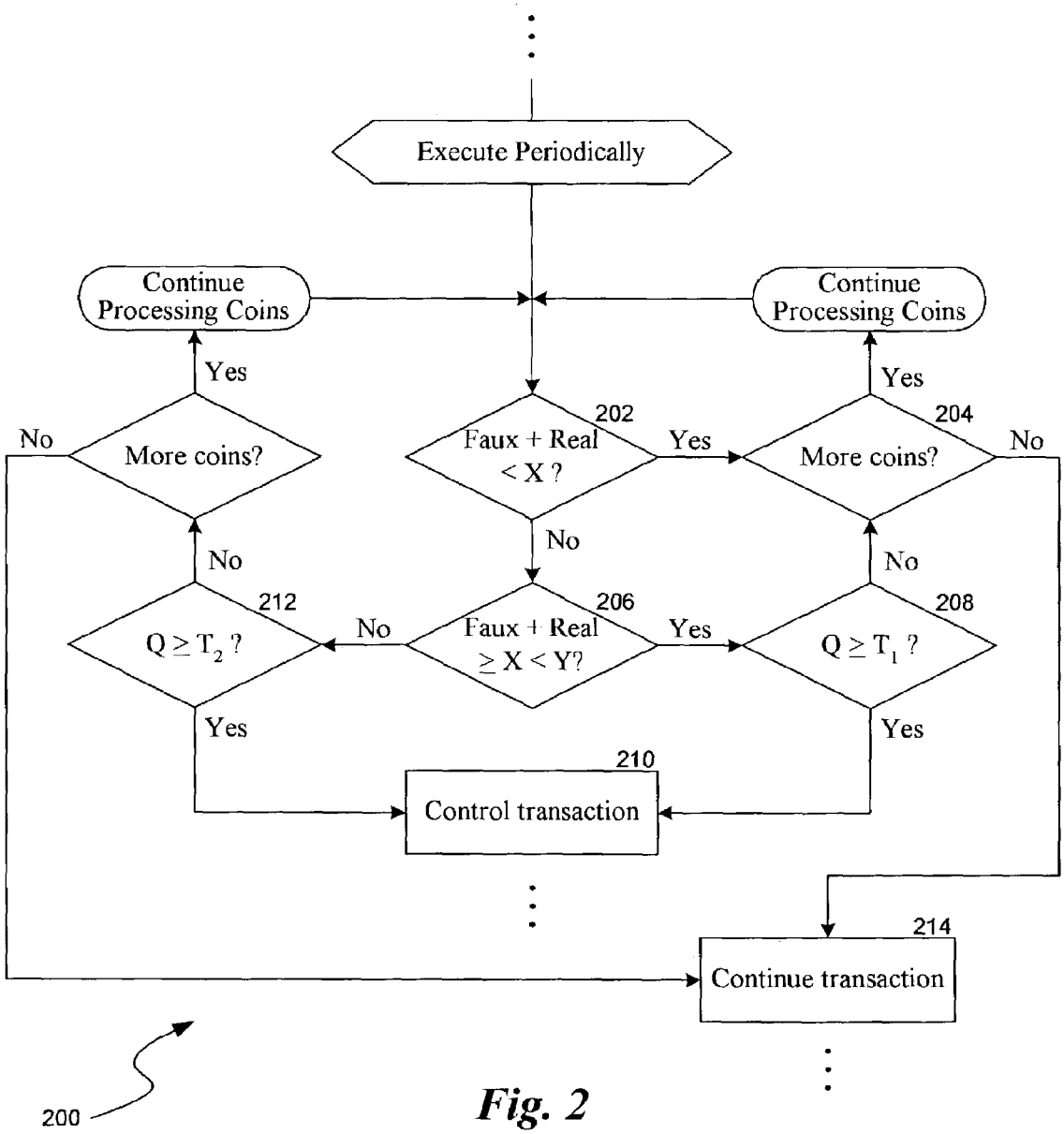
FIG. 2 is a routine for detecting coin fraud in a coin-counting machine in accordance with another embodiment.

FIG. 2 is a flow diagram of a routine 200 for detecting coin fraud in accordance with another embodiment. Certain aspects of the routine 200 are at least generally similar to aspects of the routine 100 described above with reference to FIG. 1. However, in one aspect of this embodiment the routine 200 utilizes different threshold values for the quotient Q depending on the total number of coins counted. For example, in one embodiment described in greater detail below, as the total number of coins counted increases, the threshold value for detection of a possible fraud event can decrease. For example, if the total number of coins counted is less than 11, then the quotient Q corresponding to a possible fraud event can be set at 40%. On the other hand, if the total number of coins counted exceeds 11, then the quotient associated with a possible fraud event can be decreased to 30%. In other embodiments, other threshold values can be used to suit the particular application.

Turning now to FIG. 2, in a given coin-counting transaction, the routine 200 periodically counts the total number of faux coins plus real coins counted. In decision block 202, the routine 200 determines if the number of faux coins plus real coins is less than a preselected lower limit X. In one embodiment, the lower limit X can be selected to prevent the coin-counting machine from halting a transaction after a relatively insignificant number of coins have been counted. For example, in one embodiment, the lower limit X can be selected to be less than 10, such as about 6. In other embodiments, the lower limit X can have other values depending on a number of other factors including the relative value of different coin types. If the total number of faux coins plus real coins is less than the lower limit X, then the routine 200 proceeds to decision block 204 to determine if there are more coins to be counted in the transaction. If there are more coins to be counted, then the routine 200 continues processing coins accordingly. Conversely, if there are no more coins to be counted, then the routine 200 completes the transaction in block 214. As explained above, completing the transaction in one embodiment can include dispensing a redeemable voucher to the user for a value related to the coins counted.

Returning to decision block 202, if the total number of faux coins plus real coins is greater than or equal to the lower limit X, then the routine 200 proceeds to decision block 206 to determine if the total number of faux coins plus real coins is greater than or equal to the lower limit X but less than a preselected upper limit Y. In one embodiment, the upper limit Y can be selected to be greater than the lower limit X, but not substantially greater than X. For example, if the lower limit X is 6, then the upper limit Y can be 11. In other embodiments, other limit values can be selected.

If the total number of faux coins plus real coins falls between the lower limit X and the upper limit Y, then in decision block 208 the quotient Q can be compared to a first threshold value $T_1$. As discussed above, the quotient Q can be based on the number of faux coins and the number of real coins. For example, in one embodiment, the quotient Q can be equal to the number of faux coins divided by the number of faux coins plus the number of real coins. In this embodiment, if the quotient Q is greater than or equal to the first threshold value $T_1$, then in block 210 the routine 200 can control the transaction in one or more ways as described above with reference to FIG. 1. If, however, the quotient Q is not greater than or equal to the first threshold $T_1$, then the routine 200 returns to decision block 204 to determine if there are more coins to be counted and proceeds accordingly.

Returning to decision block 206, if the number of faux coins plus real coins is equal to or greater than the upper limit Y, then in decision block 212 the routine 200 compares the quotient Q to a second threshold $T_2$ that is different than the first threshold $T_1$. In one embodiment, the second threshold $T_2$ is less than the first threshold $T_1$. Thus, in this embodiment, as the total number of coins counted increases, the Q value for detecting coin fraud decreases. Put another way, as the number of coins counted increases, the number of faux coins required to signal a coin fraud event decreases. Accordingly, this feature can lessen the impact of a fraudulent transaction involving a large number of coins.

Figure 3:
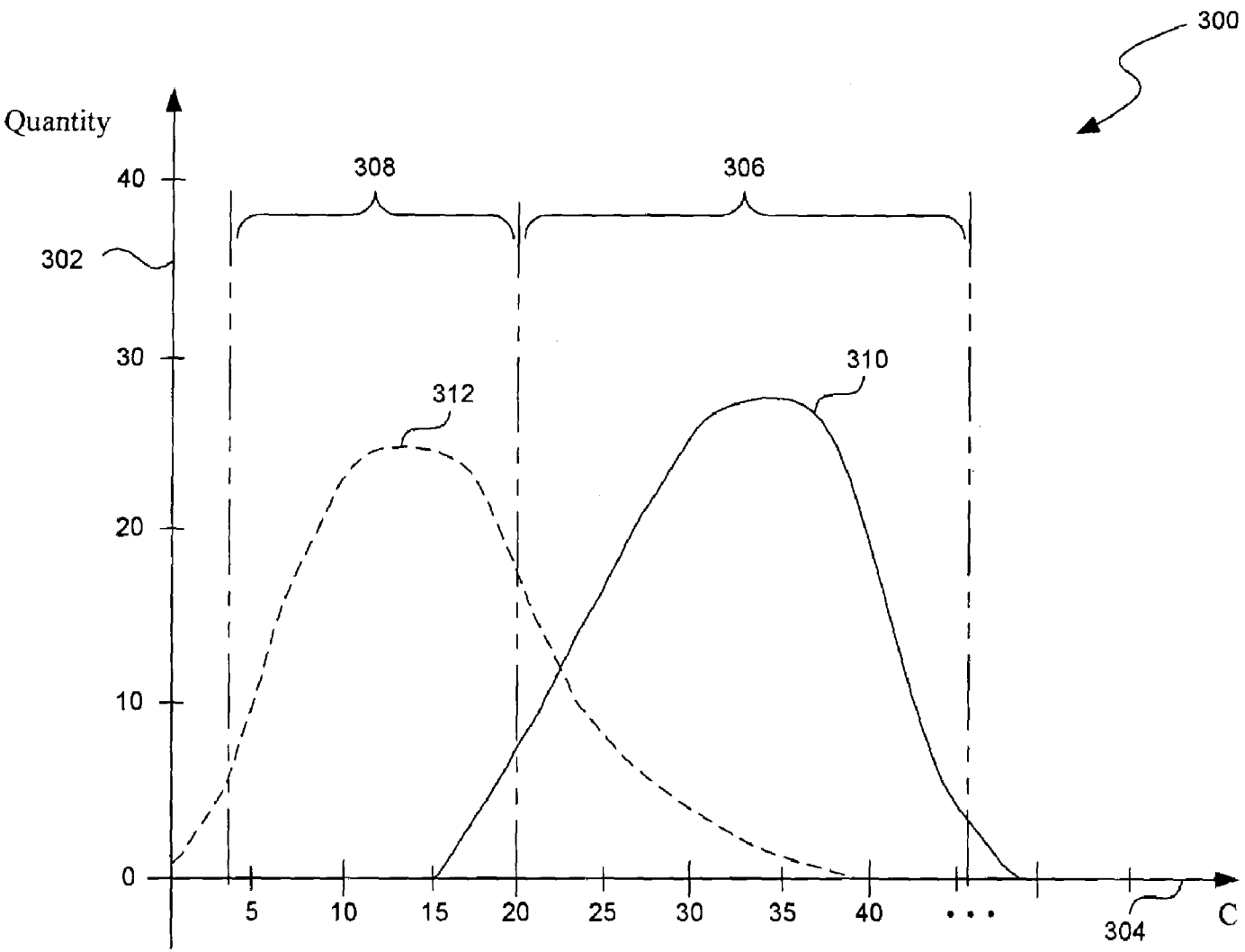
FIG. 3 is a graph of coin characteristic data for populations of real coins and faux coins in accordance with an embodiment.

FIG. 3 shows a graph 300 illustrating distributions of a selected coin characteristic for two coin populations. A characteristic distribution for a population of real coins is shown by a solid line 310, and a characteristic distribution for a population of faux coins is shown by a dashed line 312. A vertical axis 302 indicates the number of coins, and a horizontal axis 304 indicates the corresponding characteristic values as measured by a coin sensor. In one embodiment, the distributions of coin populations represented in FIG. 3 by the dashed line 312 and the solid line 310 can be shown as normal or Gaussian distributions. Accordingly, the peaks of these curves can represent the mean values, and distances from the mean can be measured in terms of deviations from the mean, or standard deviations. In practice, these curves can have other shapes different from a theoretically normal distribution without departing from the present disclosure. As can be seen with reference to FIG. 3, at least some of the faux coins exhibit characteristics that overlap the real coins. Specifically, a left-hand tail of the real coin distribution overlaps a right-hand tail of the faux coin distribution.

In another aspect, a real coin characteristic range 306 can encompass a majority of the real coins, (and a faux coin characteristic range 308 directly adjacent to the real coin range 306 can encompass a majority of the faux coins. By defining the real and faux coin ranges in this way, a portion of the coins identified as real coins may in fact be faux coins and, similarly, a portion of the coins identified as faux coins may in fact be real coins. As explained above, however, such range definitions can still be useful because a disproportionate number of coins in a given transaction falling within the faux coin range 308 can indicate fraud.

In another aspect, the coin ranges 306 and 308 shown in FIG. 3 can be dynamic or changeable depending on the circumstances. For example, the real coin range 306 can be increased or broadened as the number of real coins counted increases. In this way, as confidence increases that the transaction is legitimate, the range of acceptable coin can be increased to avoid rejecting some real coins that may have been outside the initial real coin range. On the other hand, as the number of faux coins counted increases, the faux coin range 308 can be broadened to reduce the risk of accepting some faux coins that happen to fall within the real range 306.

Although only two distributions (i.e., real and faux) are shown in FIG. 3, in other embodiments, additional ranges can be employed. For example, in another embodiment, a third range defined as "questionable" or gray range can be used. The gray range can be interposed between the real and faux ranges and defined to include those portions of the real and faux distributions that overlap. The determination of fraud can then be based on the number of gray coins counted in addition to one or more of the faux and real coins. Further, in another embodiment, the faux range 308 may be a first faux range and there may be a second faux range positioned on the other side of real coin range 306. As will be apparent to those of ordinary skill in the relevant art, the invention is not limited to the particular faux coin and real coin ranges illustrated in FIG. 3, but extends to other range arrangements that can provide information about the nature of the coins being discriminated.

Although the graph 300 only shows data for two coin populations, (i.e., real coins and faux coins) in other embodiments, there may be three or more coin populations of interest. In such an embodiment, each graph may have different ranges depending on the particular type of coin. Further, in other embodiments, multiple graphs can be used wherein each associated with a different channel or coin characteristic being examined. In such other embodiments, a coin must fall within the defined "real" range on all of the characteristic graphs to be identified as real. As will be understood by those of ordinary skill in the art, the method described above with reference to FIG. 3 for selecting or defining real coin ranges and faux coin ranges is but one embodiment in accordance with the present invention. Accordingly, in other embodiments, other methods can be used to define the respective criteria for real coins and faux coins without departing from the present disclosure.

Figure 4:
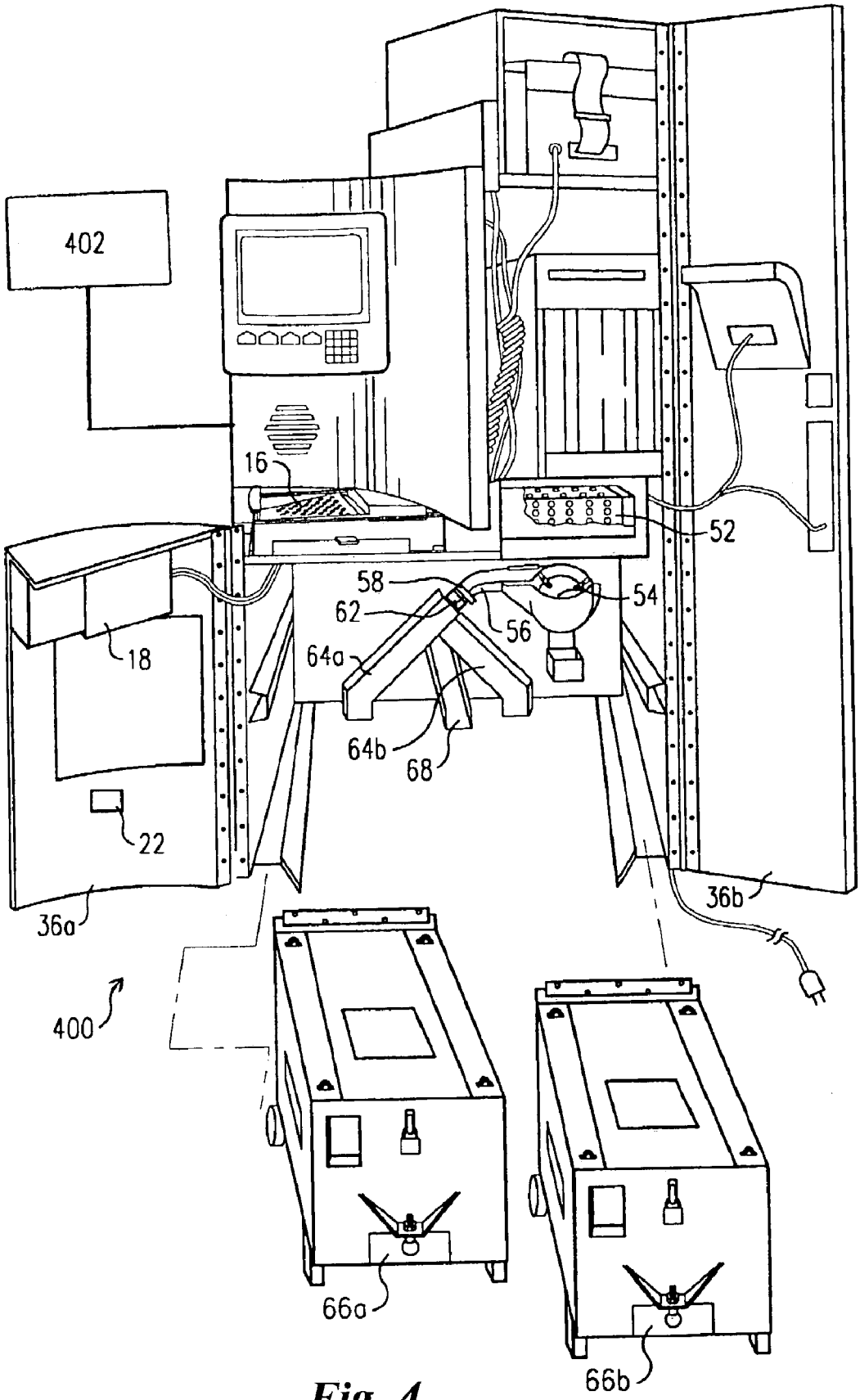
FIG. 4 is a partially schematic isometric view of a coin-counting machine in accordance with an embodiment.

FIG. 4 is a partially schematic isometric view of a coin-counting machine 400 having a coin fraud detection component 402 in accordance with an embodiment. The coin-counting machine 400 of FIG. 4 is illustrated with doors 36*a* and 36*b* open to better illustrate selected components of the coin-counting machine 400. In addition, coin bins 66*a* and 66*b* have been moved out of the coin-counting machine 400 for purposes of clarity. In one aspect of this embodiment, the coin-counting machine 400 can be similar in structure and function to one or more of the coin-counting machines described in U.S. Pat. No. 5,799,767, which is incorporated herein in its entirety by reference. In other embodiments, other coin-counting/sorting machines can be used in accordance with the present disclosure.

In another aspect of this embodiment, the coin-counting machine 400 includes a coin input region or coin tray 16 configured to receive multiple randomly oriented coins from a customer or user. From the coin tray 16, the coins proceed through the coin-counting machine 400 until they are sequentially sensed by a coin discriminator 58. Although not described in detail here, the coins can undergo a number of operations prior to reaching the discriminator 58. For example, the coins can be cleaned in a trommel 52 before being passed to a hopper 54. The coins can be lifted from the hopper 54 and sequentially delivered to the discriminator 58 by a coin rail 56. In one embodiment, the coin discriminator 58 can include at least one sensor for reading or sensing at least one coin characteristic. As mentioned above, the coin characteristic can include a dimensional characteristic, such as diameter, and/or a material characteristic, such as inductance.

After being discriminated by the coin discriminator 58, the coins can be dispositioned according to their identification. For example, if a coin is identified as a faux coin, it can be returned to the user via a first coin chute 68 that conveys the coin to a coin reject slot 22. Real coins can pass through either a second coin chute 64*a* or third coin chute 64*b* into corresponding coin bins 66*a* or 66*b*, depending on the particular denomination of the coin. In addition, as each coin is discriminated, the sensor 58 can transfer information to the coin fraud detection component 402, shown schematically in FIG. 4. The coin fraud detection component 402 can then perform a routine, such as that described above with reference to FIGS. 1 and/or 2, to determine whether the current transaction is fraudulent. If a transaction is identified as fraudulent, then the coin fraud detection component 402 can control the coin-counting machine 400 as described above with reference to FIGS. 1 and 2. For example, the coin fraud detection component 402 can instruct the coin-counting machine 400 to either halt the transaction, or return the uncounted coins to the user.

Figure 5:
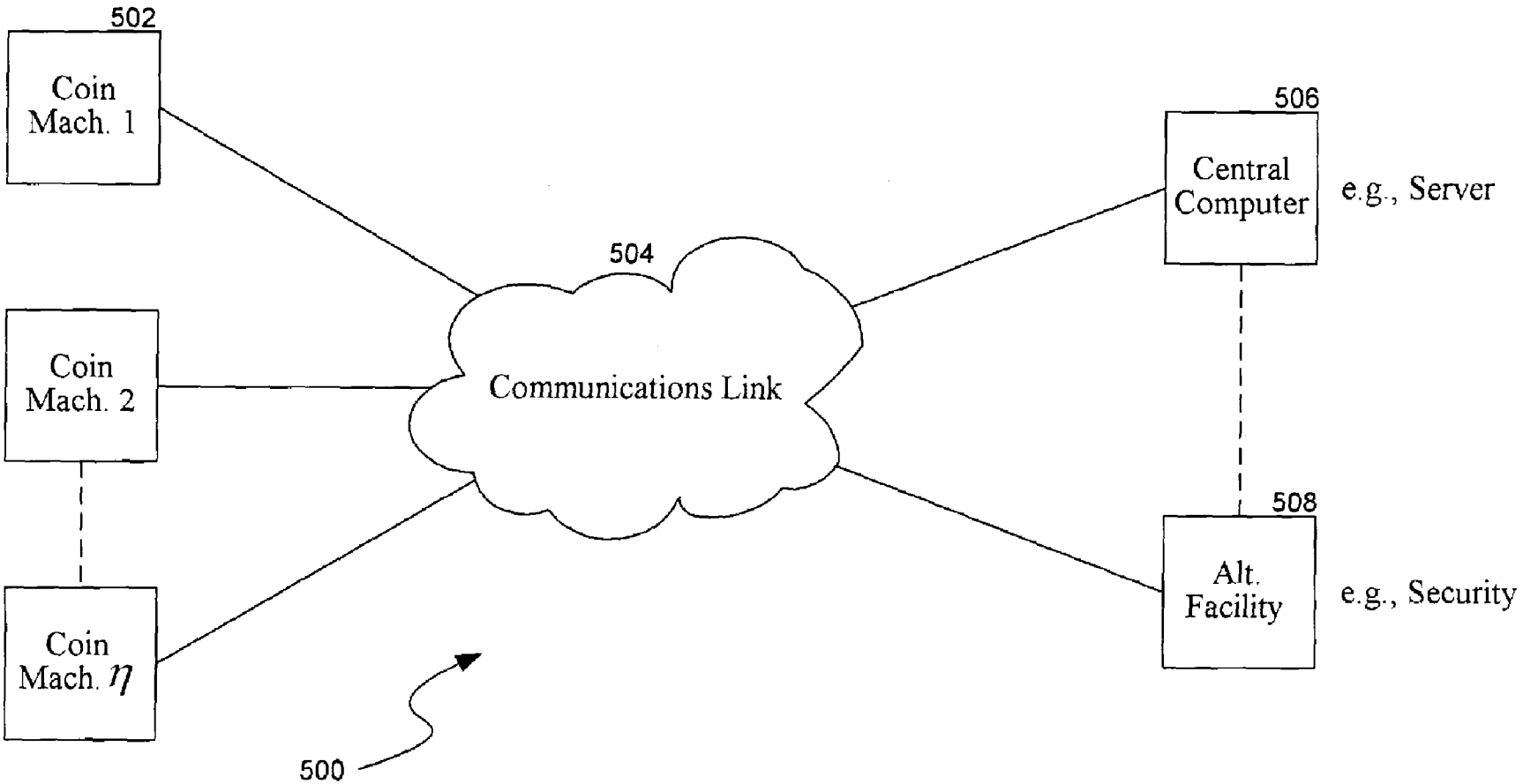
FIG. 5 is a diagram illustrating components of a network of coin-counting machines in accordance with an embodiment.

FIG. 5 is a schematic diagram illustrating aspects of a coin-counting machine network 500 configured in accordance with an embodiment. In one aspect of this embodiment, the network 500 can include multiple coin-counting machines 502 connected to a central computer 506, such as a server computer, via a communications link 504. In one embodiment, the communications link 504 can be an intranet or the Internet. In other embodiments, other communications links can be used, such as wireless links. In another aspect of this embodiment, if one of the coin-counting machines 502 determines that a coin-counting transaction may be fraudulent, the machine can transmit a signal associated with this determination to the central computer 506 via the communications link 504. Such information may be useful for a number of purposes. For example, in one embodiment, this information can be used to assess the efficiency of a particular coin fraud detection routine (for example, by assessing the efficacy of the different parameters selected, such as the Q values). In another embodiment, this information can be used to determine which of the network of coin-counting machines may require greater security measures to prevent defrauding. In other embodiments, this information can be used for other purposes, including prosecution of those persons perpetrating fraud on the coin-counting machines 502.

In a further aspect of the embodiment illustrated in FIG. 5, the network 500 can include an alternate facility 508, such as a security facility, for responding to the potentially fraudulent coin-counting transactions. For example, the security facility 508 can receive a signal or other information contemporaneously with a potentially fraudulent transaction and implement security measures accordingly in response to the signals. Such measures can include activating a video camera positioned proximate to the coin-counting machine of interest to make a video recording of the potential defrauder of the coin-counting machine. Alternatively, the signals can be used to deploy security personnel to the location of the coin-counting machine to investigate the situation.

The description of embodiments of the invention are not intended to be exhaustive or to limit the invention to the precise embodiments disclosed. While specific embodiments of, and examples for, the invention are described herein for illustrative purposes, various equivalent modifications are possible within the scope of the invention, as those of ordinary skill will recognize. For example, although certain functions may be described in the present disclose in a particular order, in alternate embodiments these functions can be performed in a different order, or the functions may be performed substantially concurrently, without departing from the spirit or scope of the present disclosure. In addition, the teachings of the present disclosure can be applied to other systems, not only the representative coin-counting systems described herein. Further, the various embodiments described herein can be combined to provide yet other embodiments.

All of the references cited herein are incorporated in their entireties by reference. Accordingly, aspects of the invention can be modified, if necessary or desirable, to employ the systems, functions and concepts of the cited references to provide yet further embodiments of the invention. Accordingly, the scope of the present invention is not limited, except by the appended claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

These and other changes can be made to the invention in light of the above detailed description. In general, the terms used in the following claims should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms. For example, while only one aspect of the invention is recited as embodied in a computer-readable medium, other aspects may likewise be embodied in a computer-readable medium. Accordingly, the inventors reserve the right to add additional claims after filing the application to pursue such additional claim forms for other aspects of the invention. Further, the invention is not limited, except as by the following claims.

I claim:

1. A method for detecting coin fraud in a coin-counting machine, the method comprising:

defining a first coin criterion associated with acceptable coins of a selected denomination;

defining a second coin criterion at least partially associated with both acceptable and unacceptable coins of the selected denomination;

receiving multiple coins of the selected denomination from a user for counting;

discriminating a portion of the coins of the selected denomination received from the user;

counting a first number of the discriminated portion of coins that satisfy the first criterion;

counting a second number of the discriminated portion of coins that satisfy the second criterion; and detecting coin fraud in the coin-counting machine based on the first and second numbers.

2. The method of claim 1, further comprising:

determining a quotient using the first and second numbers; and comparing the quotient to a threshold value, wherein detecting coin fraud includes detecting coin fraud in the coin-counting machine based on the comparison of the quotient to the threshold number.

3. The method of claim 1, further comprising:

determining a quotient using the first and second numbers;

comparing the quotient to a threshold value;

when the quotient is less than the threshold value, allowing the transaction to proceed; and when the quotient is greater than the threshold value, stopping the transaction.

4. The method of claim 1 wherein defining the first coin criterion includes defining a first range of a coin characteristic, and wherein defining the second coin criterion includes defining a second range of the coin characteristic.

5. The method of claim 1 wherein defining the first coin criterion includes defining a first range of a coin characteristic, wherein defining the second coin criterion includes defining a second range of the coin characteristic, and wherein the first and second ranges define a continuous range of the coin characteristic.

6. A method for controlling a transaction in a coin-counting machine, the method comprising:

receiving multiple coins;

discriminating at least a portion of the received coins;

counting a first number of the discriminated portion of coins that fall within a first range of a coin characteristic, the first range being related to an acceptable coin type;

counting a second number of the discriminated portion of coins that fall within a second range of the coin characteristic, the second range being related to an unacceptable coin type; and controlling the transaction based on the first and second numbers.

7. The method of claim 6, further comprising:

determining a quotient by dividing the second number by the sum of the second number plus the first number; and comparing the quotient to a threshold value, wherein controlling the transaction includes stopping the transaction and returning an uncounted portion of the received coins to a user when the quotient is greater than or equal to the threshold value.

8. The method of claim 6, further comprising:

determining a quotient by dividing the second number by the sum of the second number plus the first number; and comparing the quotient to a threshold value, wherein controlling the transaction includes controlling the transaction based on the comparison of the quotient to the threshold value.

9. The method of claim 6 wherein controlling the transaction includes stopping the transaction and returning an uncounted portion of the received coins to a user.

10. The method of claim 6 wherein controlling the transaction includes activating a camera positioned at least proximate to the coin-counting machine to obtain a photographic image of a user who deposited the multiple coins.

11. The method of claim 6 wherein controlling the transaction includes transmitting a signal related to the transaction to a remote computer using a computer network.

12. The method of claim 6, further comprising:

determining a quotient using the first and second numbers; and comparing the quotient to a threshold value, wherein controlling the transaction includes controlling the transaction based on the comparison of the quotient to the threshold value.

13. The method of claim 6, further comprising:

determining a quotient by dividing the second number by the sum of the second number plus the first number; and comparing the quotient to a threshold value, wherein controlling the transaction includes controlling the transaction based on the comparison of the quotient to the threshold value.

14. The method of claim 6 wherein the portion of the received coins is a first portion of the received coins, and wherein the method further comprises:

determining a first quotient using the first and second numbers;

comparing the first quotient to a first threshold value;

discriminating a second portion of the received coins;

counting a third number of the second portion of coins that fall within the first range of the coin characteristic;

counting a fourth number of the second portion of coins that fall within the second range of the coin characteristic;

determining a second quotient using at least the third and fourth numbers; and comparing the second quotient to a second threshold value different than the first threshold value, wherein controlling the transaction includes controlling the transaction based on the comparison of the second quotient to the second threshold value.

15. The method of claim 6 wherein the portion of the received coins is a first portion of the received coins, and wherein the method further comprises:

determining a first quotient using the first and second numbers;

comparing the first quotient to a first threshold value;

discriminating a second portion of the received coins;

counting a third number of the second discriminated portion of coins that fall within the first range of the coin characteristic;

counting a fourth number of the second discriminated portion of coins that fall within the second range of the coin characteristic;

determining a second quotient using at least the third and fourth numbers; and comparing the second quotient to a second threshold value less than the first threshold value, wherein controlling the transaction includes controlling the transaction when the second quotient is greater than or equal to the second threshold value.

16. The method of claim 6 wherein controlling the transaction includes stopping the transaction and returning an uncounted portion of the received coins to a user when the second number divided by the sum of the second number plus the first number is equal to or greater than a preselected value.

17. The method of claim 6 wherein the coin characteristic is associated with a selected coin denomination, wherein receiving multiple coins includes receiving coins of multiple denominations including the selected denomination, wherein discriminating the portion of the received coins includes discriminating coins of the selected denomination to determine the first and second numbers of the selected denomination, and wherein controlling the transaction includes stopping the transaction and returning an uncounted portion of the coins of the selected denomination to the user when the second number divided by the second number plus the first number is equal to or greater than a preselected value.

18. The method of claim 6 wherein the coin characteristic is related to at least one of a material characteristic and a dimensional characteristic.

19. A method for controlling a transaction in a coin-counting machine, the method comprising:

receiving multiple coins;

discriminating at least a portion of the received coins;

counting a number of the discriminated portion of coins having characteristics falling within at least one of a first range of a coin characteristic and a second range of the coin characteristic, the first range being at least partially related to an acceptable coin type and the second range being at least partially related to an unacceptable coin type; and controlling the transaction based on the number.

20. The method of claim 19, further comprising comparing the number to a threshold value, and wherein controlling the transaction includes initiating a coin-fraud detection routine if the number is greater than or equal to the threshold value.

21. The method of claim 19 wherein counting the number of the discriminated portion of coins includes counting the number of coins that fall within the second range, and wherein controlling the transaction includes initiating a coin-fraud detection routine if the number exceeds a minimum value.

22. The method of claim 19 wherein counting the number of the discriminated portion of coins includes counting a first number of the discriminated coins that fall within the first range and counting a second number of the discriminated coins that fall within the second range, and wherein controlling the transaction includes initiating a coin-fraud detection routine if the number exceeds the minimum value, the coin-fraud detection routine including determining a quotient based on the first and second numbers, and comparing the quotient to a threshold value.

23. A coin-counting apparatus comprising:

means for receiving multiple coins in a transaction;

means for discriminating at least a portion of the received coins;

means for counting a number of the discriminated portion of coins having characteristics that fall within a range of a coin characteristic at least partially related to an unacceptable coin type; and means for controlling the transaction based on the number.

24. The apparatus of claim 23 wherein the means for discriminating the portion of received coins includes means for sequentially sensing characteristics of the portion of coins.

25. The apparatus of claim 23 wherein the means for counting a number of the discriminated portion of coins includes means for counting a number of the coins having characteristics associated with both acceptable and unacceptable coins.

26. A method for controlling a coin-counting machine, the method comprising:

defining a preferred range associated with a measured characteristic for a selected coin denomination, wherein the preferred range has a lower threshold value and an upper threshold value;

defining at least one questionable range associated with the measured characteristic for the selected coin denomination, wherein the questionable range is approximately adjacent to at least the lower or upper threshold values; and analyzing and disposing of a given coin by:

(a) accepting the given coin and incrementing a first counting value if the coin falls outside of the preferred range but inside the questionable range;

(b) rejecting the given coin if it fails outside of the preferred and questionable ranges; and (c) accepting the given coin and incrementing a second counting value different than the first counting value if the coin falls within the preferred range.

27. A method for controlling a coin-counting machine, the method comprising:

defining a preferred range associated with a measured characteristic for a selected coin denomination, wherein the preferred range has a lower threshold value and an upper threshold value;

defining at least one questionable range associated with the measured characteristic for the selected coin denomination, wherein the questionable range is approximately adjacent to at least the lower or upper threshold values; and analyzing and disposing of a given coin by:

(a) accepting the given coin and incrementing a counting value if the coin falls outside of the preferred range but inside the questionable range;

(b) rejecting the given coin if it falls outside of the preferred and questionable ranges;

(c) accepting the given coin if it falls within the preferred range, and (d) adjusting the questionable range or the preferred range after analyzing two or more coins during a given coin-counting transaction.

28. The method of claim 27 wherein accepting the given coin if it lies within the preferred range includes not incrementing the counting value.

29. A method for controlling a coin-counting machine, the method comprising:

defining a preferred range associated with a measured characteristic for a selected coin denomination, wherein the preferred range has a lower threshold value and an upper threshold value;

defining at least one questionable range associated with the measured characteristic for the selected coin denomination, wherein the questionable range is approximately adjacent to at least the lower or upper threshold values; and analyzing and disposing of a given coin by:

(a) accepting the given coin and incrementing a counting value if the coin falls outside of the preferred range but inside the questionable range;

(b) rejecting the given coin if it falls outside of the preferred and questionable ranges; and (c) accepting the given coin if it lies within the preferred range, wherein the preferred range is N number of standard deviations from a mean value for the measured characteristic for a preferred coin of the selected coin denomination, and wherein the questionable range is at least between N and N+1 standard deviations from the mean value.

30. A computer-readable medium whose contents cause a computer to detect coin fraud in a coin-counting machine, the coin fraud being detected by a method comprising:

receiving multiple coins;

discriminating at least a portion of the received coins;

counting a first number of the discriminated portion of coins that fall within a first range of a coin characteristic, the first range being related to an acceptable coin type;

counting a second number of the discriminated portion of coins that fall within a second range of the coin characteristic, the second range being related to an unacceptable coin type; and controlling the transaction based on the first and second numbers.

31. The computer-readable medium of claim 30, wherein the method further comprises:

determining a quotient by dividing the second number by the sum of the second number plus the first number; and comparing the quotient to a threshold value, wherein controlling the transaction includes stopping the transaction and returning an uncounted portion of the received coins to a user when the quotient is greater than or equal to the threshold value.

32. The computer-readable medium of claim 30 wherein the method further comprises:

determining a quotient by dividing the second number by the sum of the second number plus the first number; and comparing the quotient to a threshold value, wherein controlling the transaction includes controlling the transaction based on the comparison of the quotient to the threshold value.

33. An apparatus for counting coins, the apparatus comprising:

a coin input region configured to receive multiple coins;

a coin discriminator positioned to receive at least a portion of the multiple coins from the coin input region and discriminate the portion of coins, the coin discriminator configured to discriminate a coin characteristic having at least a first range and a second range, the first range being related to an acceptable coin type and the second range being related to an unacceptable coin type;

a coin selector positioned to receive coins from the coin discriminator, the coin selector configured to count acceptable coins for retention within the apparatus and reject unacceptable coins; and a fraud detection component connected to the coin discriminator to receive information from the coin discriminator, the fraud detection component configured to count a first number of the portion of coins having coin characteristics that fall within the first range of the coin characteristic, the fraud detection component further configured to count a second number of the portion of coins having coin characteristics that fall within the second range of the coin characteristic, the fraud detection component still further configured to control the coin selector based on the first and second numbers.

34. The coin-counting apparatus of claim 33 wherein the coin input region includes a tray for simultaneously receiving the multiple coins in random orientation.

35. The coin-counting apparatus of claim 33 wherein the coin fraud detection component calculates a ratio of the second number divided by the sum of the first and second numbers, wherein the first and second numbers of coins include coins of a selected denomination, and wherein the coin fraud detection component controls the coin selector to reject coins of the selected denomination based on a comparison of the ratio to a threshold value.

* * * * *

UNITED STATES PATENT AND TRADEMARK OFFICE

CERTIFICATE OF CORRECTION

PATENT NO. : 7,014,029 B2
DATED : March 21, 2006
INVENTOR(S) : Gregory Winters

It is certified that error appears in the above-identified patent and that said Letters Patent is hereby corrected as shown below:

Column 14,
Line 25, "fails" should be -- falls --.

Signed and Sealed this

Sixth Day of June, 2006

JON W. DUDAS
*Director of the United States Patent and Trademark Office*